US005421619A

United States Patent [19]

Dyball

[11] Patent Number: 5,421,619

[45] Date of Patent: Jun. 6, 1995

[54] LASER IMAGED IDENTIFICATION CARD

[75] Inventor: Christopher J. Dyball, Half Moon Bay, Calif.

[73] Assignee: Drexler Technology Corporation, Mountain View, Calif.

[21] Appl. No.: 172,878

[22] Filed: Dec. 22, 1993

[51] Int. Cl.[6] ..... B42D 15/10

[52] U.S. Cl. ..... 283/86; 283/77/93; 430/140

[58] Field of Search ..... 283/85, 86, 93; 346/76 L; 235/454, 487; 358/448, 457, 462; 430/140

[56] References Cited

U.S. PATENT DOCUMENTS

| | | | |
|---|---|---|---|
| 2,395,804 | 3/1946 | De Gruchy | 283/85 |
| 4,222,662 | 9/1980 | Kruegle | 283/112 |
| 4,596,409 | 6/1986 | Holbein et al. | 283/75 |
| 4,680,459 | 7/1987 | Drexler | 235/487 |
| 4,687,526 | 8/1987 | Wilfert | 156/64 |
| 4,692,394 | 9/1987 | Drexler | 283/93 |
| 4,790,566 | 12/1988 | Boissier et al. | 283/91 |
| 5,106,719 | 4/1992 | Oshikoshi et al. | 430/203 |
| 5,157,424 | 10/1992 | Craven et al. | 346/160 |
| 5,161,826 | 11/1992 | Van Giesen et al. | 283/77 |

OTHER PUBLICATIONS

"Photo-Protected Credit Card", J. W. Kelley, IBM Technical Disclosure Bulletin, vol. 20 No. 11 A, Apr. 1978.

*Primary Examiner*—Hwei Siu Payer
*Attorney, Agent, or Firm*—Schneck & McHugh

[57] ABSTRACT

An optical data identification card for an individual containing a photograph of the authorized user and a strip of optical contrast laser recording material with a laser-written macroscopic bi-level image of the authorized user to authenticate the photograph. The bi-level image is constructed by applying a dither matrix to a digital image file corresponding to the photograph. Each dark pixel consists of an array of high-density laser recorded spots or lines.

19 Claims, 3 Drawing Sheets

| | | | |
|---|---|---|---|
| 8 | 8 | 8 | 8 |
| 8 | 8 | 8 | 8 |
| 8 | 8 | 8 | 8 |
| 8 | 8 | 8 | 8 |
34
FIG. 3a
32
| | | | |
|---|---|---|---|
| 1 | 9 | 3 | 11 |
| 13 | 5 | 15 | 7 |
| 4 | 12 | 2 | 10 |
| 15 | 8 | 14 | 6 |
FIG. 3b
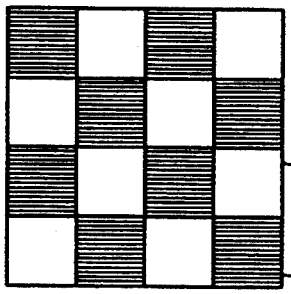
FIG. 3c
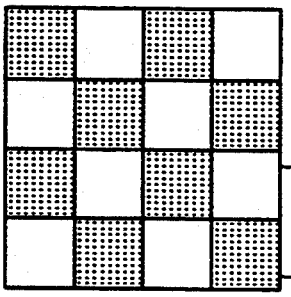
FIG. 3d

LASER IMAGED IDENTIFICATION CARD

TECHNICAL FIELD

The invention relates generally to identification cards and more particularly to an optical data storage identification card having a laser-written bi-level image of the authorized card user.

BACKGROUND ART

Identification cards such as credit cards, bank debit cards and the like are rapidly replacing cash as a preferred method for conducting commercial transactions. Consequently, forgery and fraudulent use of such cards is an increasing problem. Cards which carry photographs provide a fast and convenient means of identifying the authorized user. Fraudulent use of photographic identification cards typically involves substitution of another photograph for that of the authorized user. Cards may be made resistant to such tampering either by increasing the difficulty of photograph substitution, or by providing independent means for verifying the authenticity of the photograph on the card. Protecting the photograph against substitution significantly increases the production cost of the card, while independent verification means are generally either inconvenient to access or susceptible to forgery themselves.

U.S. Pat. No. 4,596,409, describes an identification card having a tamper-resistant grey-scale image of the authorized card user burnt into the surface of the card. The opaque plastic card body is dyed with a white titanium dioxide pigment and the image is recorded with a laser beam. The laser beam energy is controlled in such a way as to produce local irreversibly discolored zones which extend from the surface into an inner area of the card body. Discoloration is produced without destruction of the card material either by direct control of the beam strength, or by varying the length of an "impulse package" of beam energy. This method of laser writing is not practical for recording high density digital information.

U.S. Pat. No. 4,680,459 discloses an updatable micrographic data card with a strip of reflective direct-read-after-write (DRAW) laser recording material. Microscopically visible characters composed of groups of smaller laser-written spots are recorded in situ onto the strip. A magnifier with at least 10×magnification is required to read the characters. Character representation formats are not suitable for representing detailed images, such as photographs, which contain continuous shades of grey.

It is therefore an object of the present invention to provide an improved identification card having a tamper-resistant macroscopic image of the authorized card user for fast convenient verification of the authenticity of photographic or other identification data.

It is a further object to provide an improved identification card having a macroscopic verification image in a laser recording material suitable for digital recording of high-density optical data. SUMMARY OF THE INVENTION The above objects have been met with a method for recording a macroscopic image of the authorized user on the reflective laser recording material on an optical data storage card.

A dither matrix of pixel threshold values is applied to a high resolution image of the card user's face, such as a photograph or digital image file, to produce a bi-level representation of the image. A laser beam records each pixel which exceeds its associated threshold value as an array of microscopic laser spots or laser lines. The laser recording process produces a change in reflectivity of the recording material either by ablation, melting, physical or chemical change.

The uniform surface reflectivity of the laser recording material before recording typically ranges between 8% and 65%. For highly reflective material the average reflectivity over a laser-recorded spot might be in the range of 5% to 25%. Thus, the reflective contrast ratio of the recorded spots would range between 2:1 and 7:1. Laser recording materials are known in the art that create either low reflectivity spots in a moderate to high reflectivity field or high reflectivity spots in a low reflectivity field. An example of the latter type is described in U.S. Pat. No. 4,343,879. When the reflectivity of the field is in the range of 8% to 20% the reflective spots have a reflectivity of about 40%. The reflective contrast ratio would range from 2:1 to 5:1. No processing after laser recording is required when DRAW material is employed. Laser recording materials that require heat processing after laser recording may also be used.

The threshold value for individual pixels in the image is computed using a dither matrix, such as a four-by-four matrix of threshold values, which is applied to four-by-four pixel blocks in a repeated manner to cover the entire image. Each threshold-exceeding pixel in the image is represented by an array of microscopic laser spots or microscopic laser lines. This allows a macroscopic image to be recorded on the card by the same laser recording apparatus used for digitally recording high-density optical data. A tamper-resistant verification image is thus provided without increasing the production cost of the card.

BRIEF DESCRIPTION OF THE DRAWINGS

FIGS. 3*a*, 3*b*, 3*c* and 3*d* show the application of a four-by-four dither matrix to a grey level pixel array to produce a bi-level output signal.

BEST MODE FOR CARRYING OUT THE INVENTION

Figure 1:
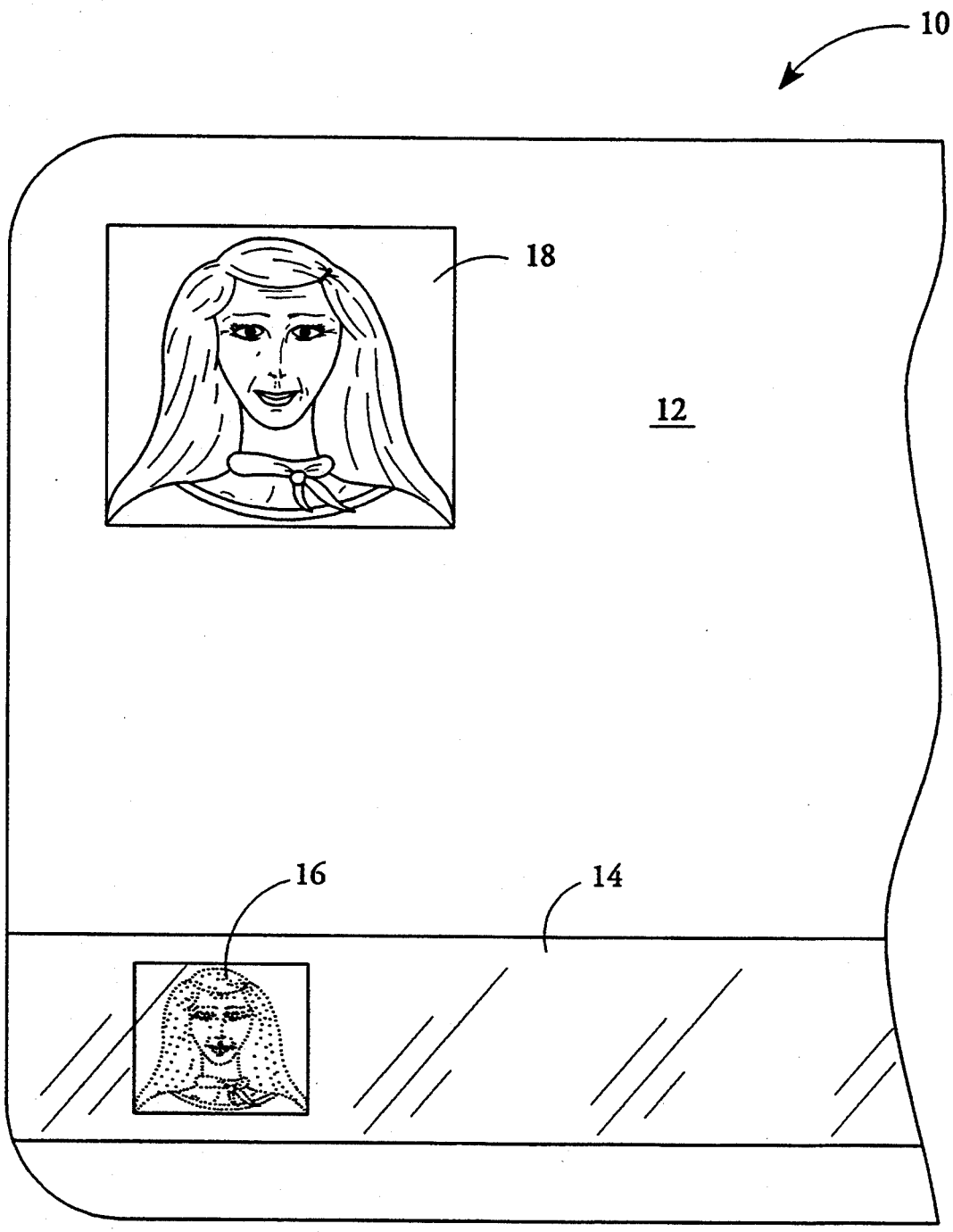
FIG. 1 is a top enlarged view showing a photograph of the card user and a laser-recorded verification image.

With reference to FIG. 1, an optical data identification card 10 is illustrated having a size common to most credit cards. The width dimension of such a card is approximately 54 mm and the length dimension is approximately 85 mm. These dimensions are not critical, but preferred because such a size easily fits into a wallet or pocket and has historically been adapted as a convenient size for automatic teller machines and the like. The card's base 12 is a dielectric, usually a plastic material such as polyvinylchloride or the like. Polycarbonate plastic is preferred. The surface finish of the base should have low specular reflectivity, preferably less than 10%.

Base 12 carries a strip of reflective optical recording material 14. The strip is typically 16 or 35 millimeters wide and extends the length of a card. Alternatively, the strip may have other sizes and orientations. The strip is relatively thin, approximately 60–200 microns, although this is not critical. Strips of laser recording material may be applied to both sides of card 10 by any convenient method which achieves flatness. Strip 14 is typically adhered to the card with an adhesive and is covered by a thin transparent laminating sheet which serves to keep strip 14 flat and protect it from dust and scratches.

The high-resolution laser-recording material which forms strip 14 may be any of the reflective recording materials which have been developed for use in DRAW optical disks, so long as the materials can be formed on thin substrates. An advantage of reflective materials over transmissive materials is that the write equipment is all on one side of the card making automatic focus easier, and twice as much data can be stored by using both sides. For example, U.S. Pat. No. 4,230,939 describes a high-resolution thin metallic recording layer of reflective metal such as Bi, Te, In, Sn, Cu, Al, Pt, Au, Rh, As, Sb, Ge, Se, and Ga. Materials which are preferred are those having high reflectivity and low melting point, particularly Cd, Sn, Te, In, Bi and amalgams. Suspensions of reflective metal particles and organic colloids also form low melting temperature laser recording media. Silver is one such metal. Typical recording media are described in U.S. Pat. Nos. 4,314,260; 4,298,684; 4,278,758; 4,278,756 and 4,269,917 all assigned to the assignee of the present invention.

The laser recording material which is selected should be compatible with the laser which is used for writing on it. Some materials are more sensitive than others at certain wavelengths. Good sensitivity to infrared light is preferred because infrared is affected least by scratches and dirt on the transparent laminating sheet. The selected recording material should have a favorable signal-to-noise ratio and form high contrast spots with the write system with which it is used.

The material should not lose data when subjected to temperatures of about 180° F. (82° C.) for long periods. The material should also be capable of recording at speeds of at least several thousand laser spots/sec. This generally precludes the use of materials that require long heating times or that rely on slow chemical reactions in the presence of heat, which may permit recording of only a few laser spots/sec. A large number of highly reflective laser recording materials have been developed for use in optical data disk applications.

Strip 14 also has a macroscopic bi-level image 16 of the authorized card user. Bi-level image 16 is used to authenticate a high resolution photographic image 18 of the authorized card user. Photographic image 18 is disposed on substrate 12 at a location adjacent to strip 14 for convenient visual comparison with bi-level image 16.

Each image pixel in bi-level image 16 is generated by an array of laser spots or continuous laser track lines. The laser forms the spots or track lines in the surrounding field of the reflective layer itself by ablation, melting, physical or chemical change, which alters the reflectivity of the recording material. The bi-level intensity of the image pixels is produced by the optical reflective contrast between the surrounding reflective field of unrecorded areas and the recorded spots or lines. Spot or line reflectivity of less than half of the reflectivity of the surrounding field produces a contrast ratio of at least two to one, which is sufficient contrast for reading the image with the naked/unaided eye. Greater contrast is preferred. Reflectivity of the strip field of about fifty percent is preferred with reflectivity of a spot or line in the reflective field being less than 10% thus creating a contrast ratio of greater than five to one. Alternatively, data may also be recorded by increasing the reflectivity of the strip. For example, the recording laser can melt a field of dull microscopic spikes on the strip to create flat shiny spots or lines. This method is described in SPIE, Vol. 329, Optical Disk Technology (1982), p. 202. A spot reflectivity of more than twice the surrounding field reflectivity produces a contrast ratio of at least two to one, which is sufficient contrast for reading.

Figure 2:
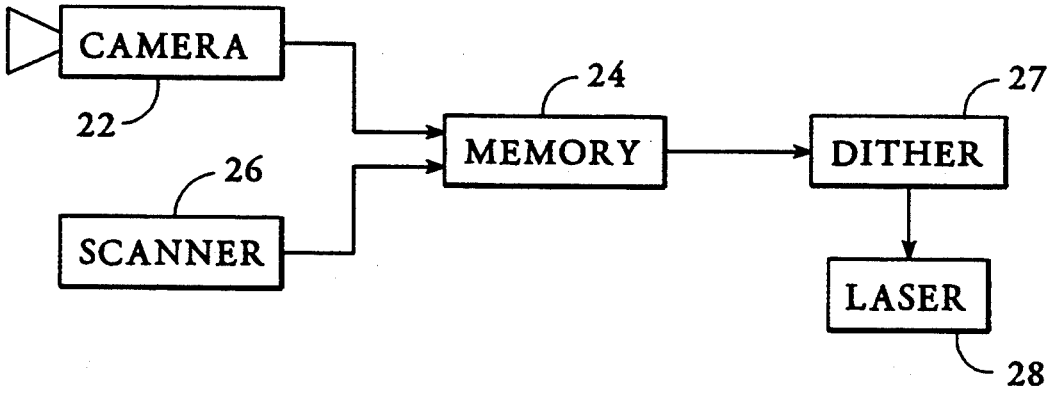
FIG. 2 is a block diagram of a system for producing a bi-level verification image in accordance with the present invention.

A system for producing bi-level macroscopic laser images of the type shown in FIG. 1 is illustrated in block diagram form in FIG. 2. This system includes a camera 22, for capturing a portrait of the authorized card user. In preferred embodiments, camera 22 is an electronic camera, which generates a digital signal representative of the image captured thereby. This digital image signal is provided to a memory 24 as a digital image file.

Alternatively, it is possible to use a photographic camera, and subsequently digitize the photograph provided thereby with a scanner 26 to generate a digital information file that is stored in memory 24. Each image pixel is stored as a digital image intensity in memory 24. The image intensity information stored in memory 24 is transferred to a dither processing circuit 27 which converts the image intensity data into a bi-level dither image. Each image pixel which has an intensity which exceeds its associated threshold in a dither matrix is represented by a laser 28 as an array of spots or lines on the optical recording material. Typical laser spot sizes range from about 1 micron to about 10 microns in diameter with a center-to-center separation, or pitch, of about 5 microns between adjacent spots or line tracks.

Referring now to FIGS. 3*a–d*, a typical four-by-four dither matrix 32 is used to convert a four-by-four block of image pixels 34 into a bi-level image representation 36. For example, in a system having sixteen grey-scale levels, 0–15, an area of intermediate image intensity would be represented by a four-by-four matrix in which all the pixel intensities had a value of eight. Application of dither matrix 32 to such an area produces a four-by-four matrix of bi-level pixels 36 with alternating light and dark areas. Any other well known dither processing method, such as those described in U.S. Pat. Nos. 4,996,602; 4,996,603; 4,955,065 and references therein, may also be employed to produce a bi-level pixel image from a continuous tone image. In FIG. 3*c*, each dark pixel 37 in bi-level matrix 36 is a uniform array of laser-recorded lines. Alternatively, in FIG. 3*d*, each dark pixel 39 in bi-level matrix 36 is a uniform array of laser-recorded spots. Typical image pixels range in size from about 1 micron to about 50 microns.

Figure 4:
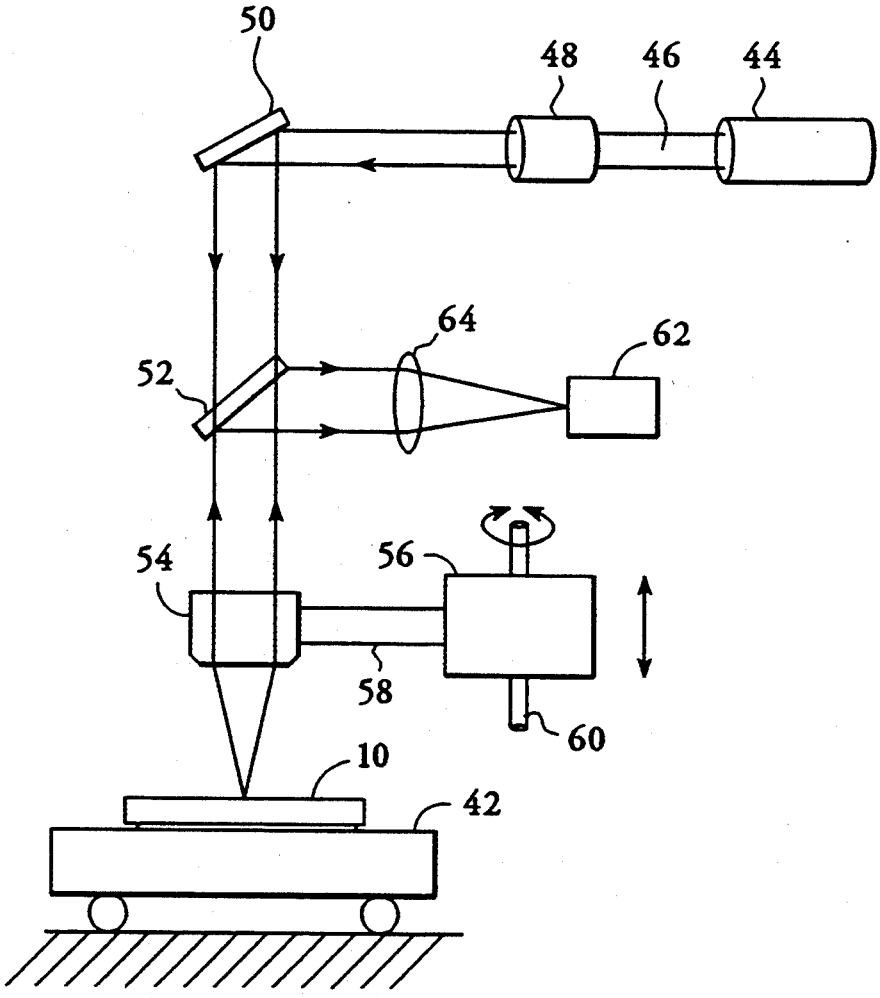
FIG. 4 is a plan view of optical apparatus for reading and writing on the data strip portion of the card illustrated in FIG. 1.

Referring now to FIG. 4, a laser recording apparatus suitable for writing information on data strip 14 is illustrated. Optical data card 10 of FIG. 1 is placed on a movable holder 42 which brings data strip 14 into the trajectory of a laser beam. A laser light source 44, preferably a pulsed semiconductor laser of infrared wavelength, emits a beam 46 which passes through collimating optics 48. The beam is then directed by mirror 50 through a beamsplitter 52 to an objective lens 54.

The beam is focused by objective lens 54 onto card 10 as a fine light spot. An objective lens actuator 56, of the type used in compact disc players, is connected to objective lens 54 via an arm 58 perpendicular to the optical axis of objective lens 54. Objective lens actuator 56 is movably mounted on a shaft 60. Focus is controlled by vertical motion along shaft 60 as indicated by the arrows, while tracking is maintained by rotation about the shaft axis. Focusing and tracking servo control is provided by magnetic coils located in objective lens actuator 56.

Control of the lengthwise motion of the data strip relative to the beam is achieved by motion of movable holder 42. Position of the holder may be established by a linear magnetic motor and tested by a closed loop position servo system of the type used in magnetic disk drives. Reference position information may be prerecorded on the card so that position error signals may be generated and used as feedback in motor control. Upon writing one row of pixels, a dc servo motor steps the track by displacing the optics relative to holder 42 in the direction perpendicular to the plane of the page. The linear motor then moves holder 42 lengthwise at about 400 mm/sec so that the next row can be written, and so on. When writing macroscopically visible image pixels, the dc servo motor is used to identify pixel sites at predetermined distances from the edges. Holder 42 moves the scanning beam lengthwise from pixel site to pixel site. Within a pixel site, objective lens actuator 56 and movable holder 42 cooperate to move the beam in either a zig-zag pattern or a raster-like pattern. Laser spots or lines are written on all locations within a pixel site to form a dark pixel. When one pixel has been written, movable holder 42 moves the beam 46 to the next pixel site.

As light is scattered and reflected from spots or lines in the laser recording material, the percentage of reflected light from the incident beam changes relative to surrounding material where no spots or lines exist. The incident laser beam should deliver sufficient laser energy to the surface of the recording material to create spots or lines, but should be lowered when reading so as not to cause disruption of the surface during the reading method. The wavelength of the laser should be compatible with the recording material to achieve this purpose.

Differences in reflectivity between spot or line and surrounding material may be detected by a light detector 62 which may be a photodiode. Detector 64 confirms laser writing. Light is focused onto detector 62 by beamsplitter 52 and focusing lens 64. Servo mechanisms, not shown, control the position of the optics and drive objective lens actuator 56 in accord with instructions received from control circuits, as well as from feedback devices. Detector 62 produces electrical signals corresponding to recorded spots or lines. Once recorded, the bi-level image is visually observable without the aid of additional optics.

I claim:

1. A method for producing a laser-imaged identification card for an individual user comprising:

providing a self-supporting card-sized substrate overlaying reflective laser recording material on said self-supporting card-sized substrate;

applying a dither matrix of pixel threshold values to an image of the card user's face to produce a dithered representation of said image; and recording said dithered representation onto said laser recording material in a macroscopic format by means of a laser beam, producing a laser-written image being visually perceivable by reflecting visible light.

2. The method of claim 1 further comprising:

overlaying a photographic recording material containing said image of the card user's face on said substrate in a format visually comparable to said dithered representation.

3. The method of claim 1 wherein recording said dithered representation comprises laser writing a plurality of spots onto said laser recording material, each of said spots corresponding to a pixel in said image of the card user's face which exceeds its associated pixel threshold.

4. The method of claim 1 wherein recording said dithered representation comprises laser writing a plurality of lines in said laser recording material, each of said lines corresponding to a pixel in said image of the card user's face which exceeds its associated pixel threshold.

5. The method of claim 1 further comprising:

generating a digital image file corresponding to said image of the card user's face; and recording said digital image file in said laser recording material in a machine readable format.

6. A laser image identification card for an individual user comprising:

a card-sized self-supporting substrate;

a reflective recording material overlaying said substrate defining an unrecorded area; and a laser written image of a face of said user disposed on said recording material, said image having pixels each including an intensity which exceeds that of an associated threshold in a dither matrix, each pixel intensity represented by at least one spot.

7. The card of claim 1 wherein each of said threshold exceeding pixels is represented by a plurality of said laser-written spots.

8. The card of claim 6 wherein said image comprises a plurality of laser-written lines, each of said lines corresponding to a pixel in said image which exceed a threshold value associated with said pixel in a dither matrix.

9. The card of claim 8 wherein each of said threshold exceeding pixels is represented by a plurality of said laser-written lines.

10. An identification card for an individual user comprising in combination:

a card-sized self-supporting substrate; and laser recording material overlaying said substrate, defining a data strip, said data strip containing both a laser-written image of the face of said user and data, and said laser written image being visually perceivable.

11. The card of claim 10 further including a photographic image of the card user disposed on a surface of said substrate.

12. The card of claim 11 wherein said photographic image is generated from a digital image file.

13. The card of claim 12 wherein said laser written image is disposed on said laser recording material in machine readable format.

14. The card of claim 11 wherein said laser-written image is a dithered representation of said photographic image.

15. The card of claim 14 wherein said laser-written image comprises a plurality of spots.

16. The card of claim 14 wherein said laser-written image comprises a plurality of lines.

17. The card of claim 11 wherein said photographic image and said laser-written image are disposed adjacent to one another on a major surface of said substrate.

18. The card of claim 11 wherein said photographic image is disposed on a first major surface of said substrate and said laser-written image is disposed on a second major surface of said substrate opposed to said first major surface.

19. The card in claim 10 wherein said image has pixels, each with an intensity which exceeds that of an associated threshold in a dither matrix, each pixel intensity represented by at least one spot.

* * * * *